US007591636B2

(12) United States Patent
Ikeda

(10) Patent No.: US 7,591,636 B2
(45) Date of Patent: Sep. 22, 2009

(54) NEGATIVE PRESSURE SUPPLY APPARATUS

(75) Inventor: Junichi Ikeda, Tokyo (JP)

(73) Assignee: Kabushiki Kaisha Hitachi Seisakusho, Tokyo (JP)

( * ) Notice: Subject to any disclaimer, the term of this patent is extended or adjusted under 35 U.S.C. 154(b) by 416 days.

(21) Appl. No.: 10/924,881

(22) Filed: Aug. 25, 2004

(65) Prior Publication Data

US 2005/0095142 A1 May 5, 2005

(30) Foreign Application Priority Data

Oct. 31, 2003 (JP) ..... 2003-373259

(51) Int. Cl.
*F04F 5/00* (2006.01)
*F04B 23/04* (2006.01)

(52) U.S. Cl. ..... 417/174; 417/79; 417/158; 417/169; 137/831

(58) Field of Classification Search ..... 417/79, 417/168, 174, 419, 85, 86, 88, 158, 159, 417/163, 165, 167, 169, 170; 137/831, 833, 137/832, 834, 835
See application file for complete search history.

(56) References Cited

U.S. PATENT DOCUMENTS 3,340,896 A * 9/1967 Mon et al. ..... 137/624.13
3,942,559 A * 3/1976 Kranz et al. ..... 137/831
4,006,755 A * 2/1977 Kranz et al. ..... 137/831
6,862,882 B2 * 3/2005 Takayama et al. ..... 60/397
2003/0007874 A1 * 1/2003 Ikeda et al. ..... 417/198

FOREIGN PATENT DOCUMENTS

| | | | |
|---|---|---|---|
| JP | 60092151 A | * | 5/1985 |
| JP | 64-19189 | | 1/1989 |
| JP | 6-185499 | | 7/1994 |
| JP | 8-192737 | | 7/1996 |
| JP | 10138909 A | * | 5/1998 |
| JP | 10138910 A | * | 5/1998 |
| JP | 11-82346 | | 3/1999 |

OTHER PUBLICATIONS

Japanese Office Action(with partial English translation) issued Mar. 25, 2009 in corresponding Japanese Application No. 2004-286681.

* cited by examiner

*Primary Examiner*—Devon C Kramer
*Assistant Examiner*—Leonard J Weinstein
(74) *Attorney, Agent, or Firm*—Wenderoth, Lind & Ponack, L.L.P.

(57) ABSTRACT

When coils of a vacuum pump unit are excited by energization, a piston equipped with magnets reciprocates in a cylinder. Thus, air is sucked in from an outlet passage of a diffuser of an ejector, and air discharged from the vacuum pump unit is supplied to an inlet of a nozzle of the ejector. Consequently, a fast jet occurs in a throat portion of the nozzle, and a negative pressure of higher degree of vacuum than that of the suction negative pressure of the vacuum pump unit is produced at a vacuum port of the ejector. The negative pressure is supplied from a negative pressure supply port. The ejector can supply a negative pressure of high degree of vacuum while reducing the load on the vacuum pump unit.

15 Claims, 4 Drawing Sheets

NEGATIVE PRESSURE SUPPLY APPARATUS

BACKGROUND OF THE INVENTION

The present invention relates to a negative pressure supply apparatus for supplying a negative pressure to a pneumatic booster of an automotive brake system, for example.

In general, an automotive brake system is provided with a pneumatic booster to increase braking force. The pneumatic booster uses the engine intake (negative) pressure as a negative pressure source. That is, the engine intake (negative) pressure is introduced into a constant-pressure chamber (negative pressure chamber) to produce a differential pressure between the intake pressure and the atmospheric pressure, thereby generating thrust in a power piston to assist the brake system with operating force.

In recent years, automotive engines have been improved to reduce pumping loss in order to meet the demand for lower fuel consumption. Accordingly, the engine intake (negative) pressure is tending to decrease. Consequently, the negative pressure supplied to the pneumatic booster is likely to become insufficient.

In view of the above-described problem, a conventional technique uses an electrically-driven rotary vacuum pump as a negative pressure source of a pneumatic booster, so that a sufficient negative pressure can be supplied to the pneumatic booster irrespective of the engine running condition, as disclosed, for example, in Japanese Patent Application Unexamined Publication (KOKAI) No. 2002-195178.

However, the vacuum pump disclosed in the above-described publication suffers from the following problems. The conventional technique uses a vane pump as a vacuum pump. The vane pump has a complicated structure and a high production cost and is difficult to reduce in size. It is also conceivable to use a reciprocating piston type vacuum pump having a simple structure. In the reciprocating piston type vacuum pump, however, the atmospheric pressure acts on the piston as back pressure. Therefore, if the pump is used to obtain a high degree of vacuum required for the pneumatic booster, the load variation increases, and it becomes difficult to perform a smooth operation.

SUMMARY OF THE INVENTION

The present invention was made in view of the above-described circumstances.

An object of the present invention is to provide a negative pressure supply apparatus capable of supplying a negative pressure of high degree of vacuum with a simple structure.

The present invention provides a negative pressure supply apparatus including an ejector that has a nozzle and a diffuser disposed downstream of the nozzle. A vacuum port of the ejector opens between the nozzle and the diffuser. The negative pressure supply apparatus further includes a vacuum pump having a suction port connected to an outlet of the diffuser. A negative pressure is supplied from the vacuum port of the ejector.

In the negative pressure supply apparatus according to the present invention, suction by the vacuum pump causes air to flow from the nozzle to the diffuser in the ejector. Consequently, a fast jet is produced in a throat portion of the nozzle, and a negative pressure of higher degree of vacuum than that of the suction negative pressure of the vacuum pump is produced at the vacuum port of the ejector. Thus, it is possible to supply the negative pressure of high degree of vacuum.

The negative pressure supply apparatus according to the present invention may be arranged as follows. The vacuum port of the ejector and the suction port of the vacuum pump are connected to a negative pressure supply port through respective check valves. Either one of two negative pressures at the vacuum port and the suction port that is higher in the degree of vacuum than the other is supplied from the negative pressure supply port.

With the above-described arrangement, either the negative pressure at the vacuum port of the ejector or the negative pressure at the suction port of the vacuum pump that is higher in the degree of vacuum than the other negative pressure can be supplied through the associated check valve. Therefore, the negative pressure can be supplied efficiently.

The vacuum pump used in the negative pressure supply apparatus according to the present invention may be a reciprocation-type pump having a piston driven by a linear actuator.

With the above-described arrangement, the structure of the vacuum pump can be simplified, and it becomes possible to reduce the size and the production cost.

DETAILED DESCRIPTION OF THE INVENTION

Embodiments of the present invention will be described below with reference to the accompanying drawings.

Figure 1:
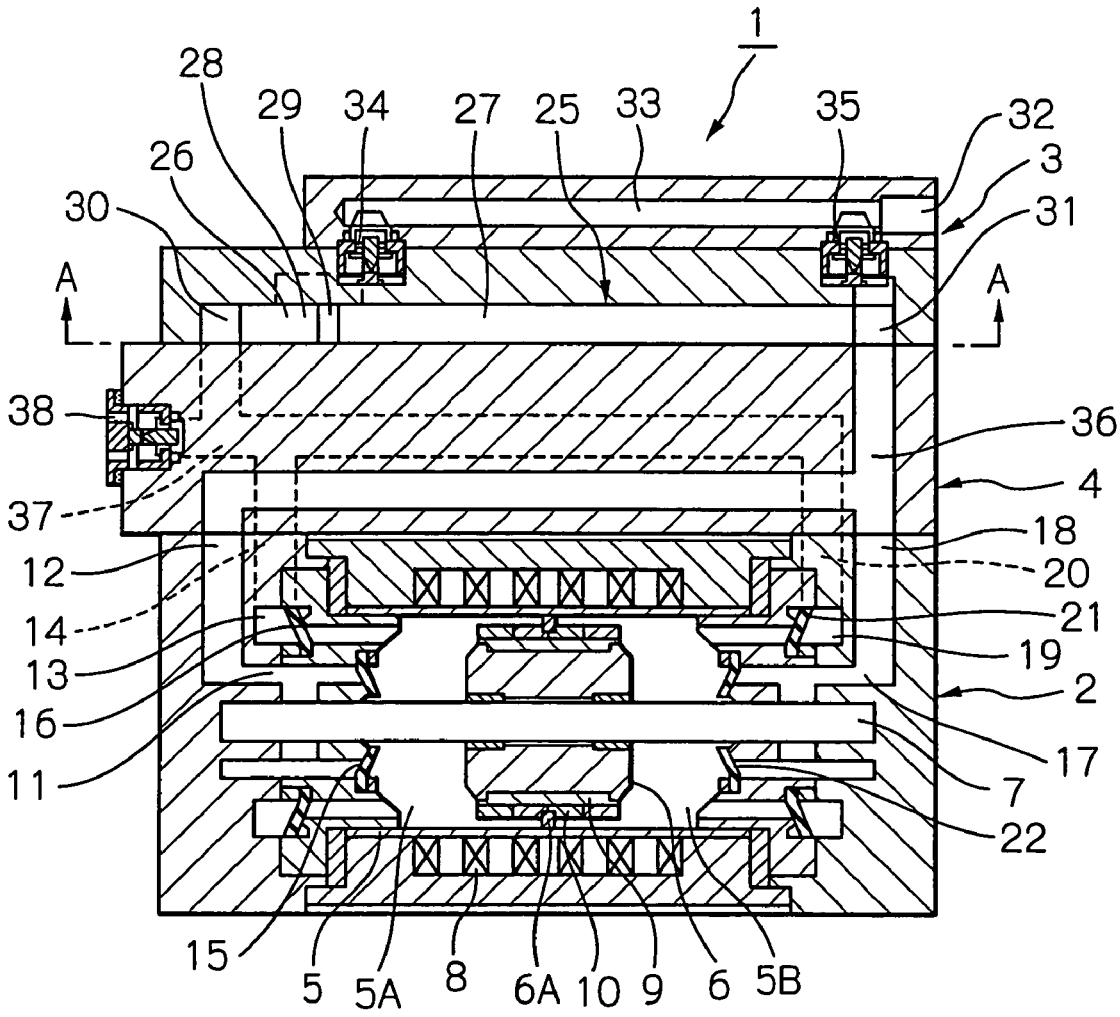
FIG. 1 is a longitudinal sectional view of a negative pressure supply apparatus according to a first embodiment of the present invention.
Figure 2:
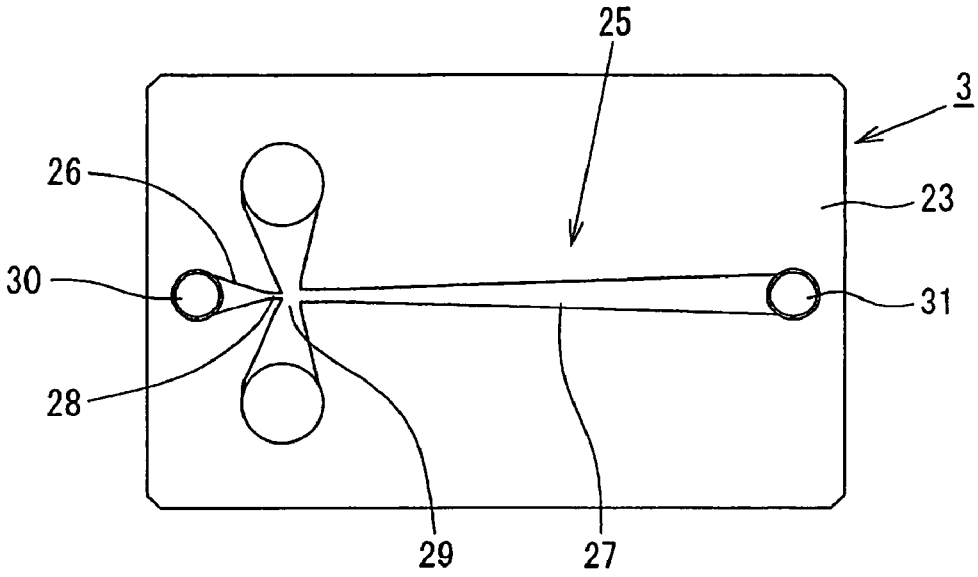
FIG. 2 is a sectional view taken along the line A-A in FIG. 1.
Figure 3:
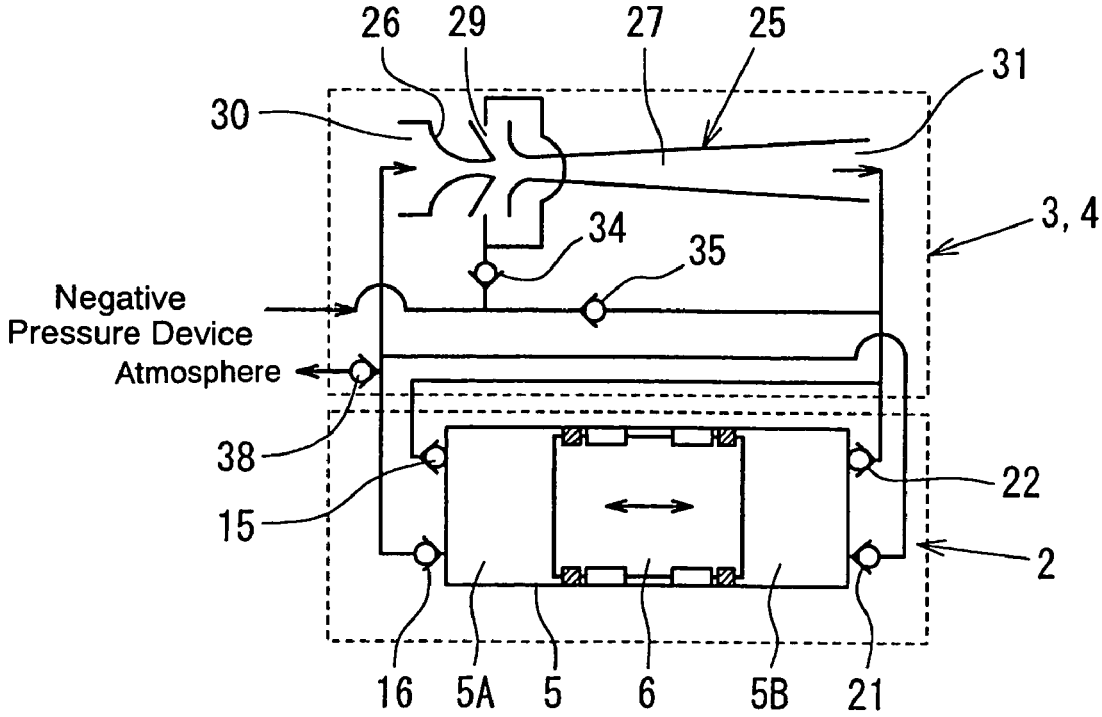
FIG. 3 is a pneumatic pressure circuit diagram showing the arrangement of the apparatus shown in FIG. 1.

A first embodiment of the present invention will be described with reference to FIGS. 1 to 3. As shown in FIGS. 1 to 3, a negative pressure supply apparatus 1 according to this embodiment has a vacuum pump unit 2 (vacuum pump) and an ejector unit 3, which are joined to each other through a manifold unit 4.

The vacuum pump unit 2 is a reciprocation-type pump having a piston driven by a moving magnet type linear motor. That is, a piston 6 serving also as a moving member is slidably fitted in a cylinder 5 serving also as a stator. The piston 6 is guided by a rod 7 secured in the cylinder 5. The rod 7 extends along the center axis of the cylinder 5. The cylinder 5 has a plurality of coils 8 installed on an outer peripheral portion thereof. The piston 6 has a magnetic path member 9 and a plurality of magnets 10 installed on an outer peripheral portion thereof. By energizing and thus exciting the coils 8 sequentially, the piston 6 can be moved to reciprocate in the cylinder 5. An annular seal 6A is provided on the center of the magnets 10 to divide the interior of the cylinder 5 into two chambers (described later). The annular seal 6A is formed from a synthetic resin exhibiting excellent sliding performance.

The interior of the cylinder 5 is divided by the piston 6 into two chambers 5A and 5B (pump chambers). One chamber 5A communicates with a first suction port 12 through a passage 11 and also communicates with a first discharge port 14 through a passage 13. The passage 11 is provided with a check valve 15 that allows flow of air only in one direction from the first suction port 12 toward the chamber 5A. The passage 13 is provided with a check valve 16 that allows flow of air only in one direction from the chamber 5A toward the first discharge port 14. The other chamber 5B communicates with a second suction port 18 through a passage 17 and also communicates with a second discharge port 20 through a passage 19. The passage 17 is provided with a check valve 22 that allows flow of air only in one direction from the second suction port 18 toward the chamber 5B. The passage 19 is provided with a check valve 21 that allows flow of air only in one direction from the chamber 5B toward the second discharge port 20. The first and second suction ports 12 and 18 and the first and second discharge ports 14 and 20 are disposed to face the manifold unit 4.

The ejector unit 3 is formed with an ejector 25. As shown in FIG. 2, the ejector 25 has a nozzle 26 and a diffuser 27 disposed downstream of the nozzle 26 to form a Laval nozzle. Vacuum ports 29 are open in an area downstream of a throat portion 28 of the nozzle 26. When a gas is supplied to flow from an inlet 30 of the nozzle 26 toward an outlet passage 31 (outlet) of the diffuser 27, a fast jet reaching the velocity of sound is generated at the throat portion 28. The fast jet sucks gas from the vacuum ports 29. Thus, a negative pressure of higher degree of vacuum than that of the negative pressure in the outlet passage 31 of the diffuser 27 can be obtained from the vacuum ports 29. The ejector 25 has a two-dimensional configuration formed from a planar recess provided on a joint surface of the ejector unit 3 at which it is joined to the manifold unit 4. Thus, the ejector 25 having a complicated configuration can be formed easily with high accuracy.

The ejector unit 3 is provided with a negative pressure supply port 32 for connection with a negative pressure operated device (not shown) such as a pneumatic booster. The negative pressure supply port 32 communicates with the vacuum ports 29 and the outlet passage 31 via a passage 33 through respective check valves 34 and 35. The check valve 34 allows flow of air only in one direction from the negative pressure supply port 32 toward hollow spaces communicated with the vacuum ports 29. The check valve 35 allows flow of air only in one direction from the negative pressure supply port 32 toward the outlet passage 31.

The manifold unit 4 is provided with a suction passage 36 for communication between the first and second suction ports 12 and 18 of the vacuum pump unit 2 and the outlet passage 31 of the ejector unit 3. The manifold unit 4 is further provided with a discharge passage 37 for communication between the first and second discharge ports 14 and 20 of the vacuum pump unit 2 and the inlet 30 of the ejector unit 3. The discharge passage 37 is open to the atmosphere through a check valve 38. The check valve 38 allows flow of air only in one direction from the discharge passage 37 toward the atmosphere.

The operation of this embodiment, arranged as stated above, will be described below.

When the coils 8 of the vacuum pump unit 2 are excited by energization, the piston 6 in the cylinder 5 reciprocates by the action of magnetic fields from the coils 8. Consequently, air is sucked in from the first and second suction ports 12 and 18 through the check valves 15 and 22, and air is discharged from the first and second discharge ports 14 and 20 through the check valves 16 and 21. Thus, air is sucked in from the outlet passage 31 of the ejector 25 through the suction passage 36 of the manifold unit 4. The discharged air is supplied to the inlet 30 of the ejector 25 through the discharge passage 37. At this time, the check valve 38 prevents the pressure in the discharge passage 37 from becoming a positive pressure.

Thus, air flows from the inlet 30 of the nozzle 26 toward the outlet passage 31 of the diffuser 27. Consequently, a fast jet reaching the velocity of sound occurs by the action of the combination of the nozzle 26 and the diffuser 27, which form a Laval nozzle, and a negative pressure of higher degree of vacuum than that of the suction negative pressure of the vacuum pump unit 2 is produced at the vacuum ports 29. The negative pressure of high degree of vacuum is supplied from the negative pressure supply port 32 to a negative pressure operated device, e.g. a pneumatic booster, through the check valve 34.

In this way, the negative pressure produced in the vacuum pump unit 2 can be boosted by the ejector 25, and it is possible to supply a negative pressure of high degree of vacuum that is required for a negative pressure operated device, e.g. a pneumatic booster, while reducing the load on the vacuum pump unit 2. At this time, if a negative pressure of the order of from −250 mmHg to −300 mmHg is produced by the vacuum pump unit 2, a negative pressure of the order of −500 mmHg can be supplied. As a result, the load on the vacuum pump unit 2 can be reduced. Therefore, it becomes possible to make the vacuum pump compact in size. Further, because the load variation due to suction and discharge is reduced, it becomes possible to attain smooth operation of the vacuum pump.

In a case where the negative pressure supply apparatus 1 is used for a pneumatic booster of an automotive brake system, for example, the negative pressure in the pneumatic booster may be extremely reduced by continuous operation of the brake. In such a case, the check valve 35 opens to suck in air directly from the negative pressure supply port 32 through the first and second suction ports 12 and 18 of the vacuum pump unit 2, thereby increasing the suction flow rate. Thus, the negative pressure in the pneumatic booster can be recovered rapidly.

Next, a second embodiment of the present invention will be described with reference to FIGS. 4 and 5.

It should be noted that, in the following description, members or portions corresponding to those in the foregoing first embodiment are denoted by the same reference numerals, and only portions in which the second embodiment differs from the first embodiment will be explained in detail.

Figure 4:
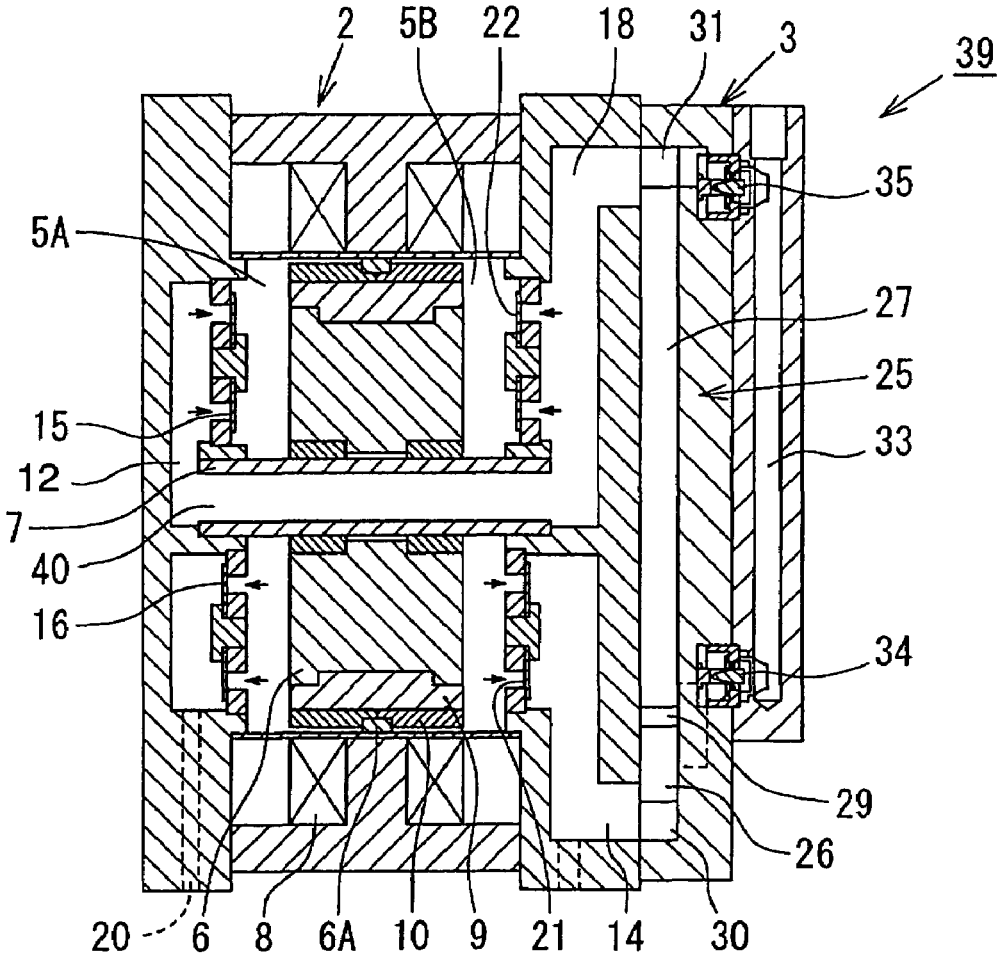
FIG. 4 is a longitudinal sectional view of a negative pressure supply apparatus according to a second embodiment of the present invention.
Figure 5:
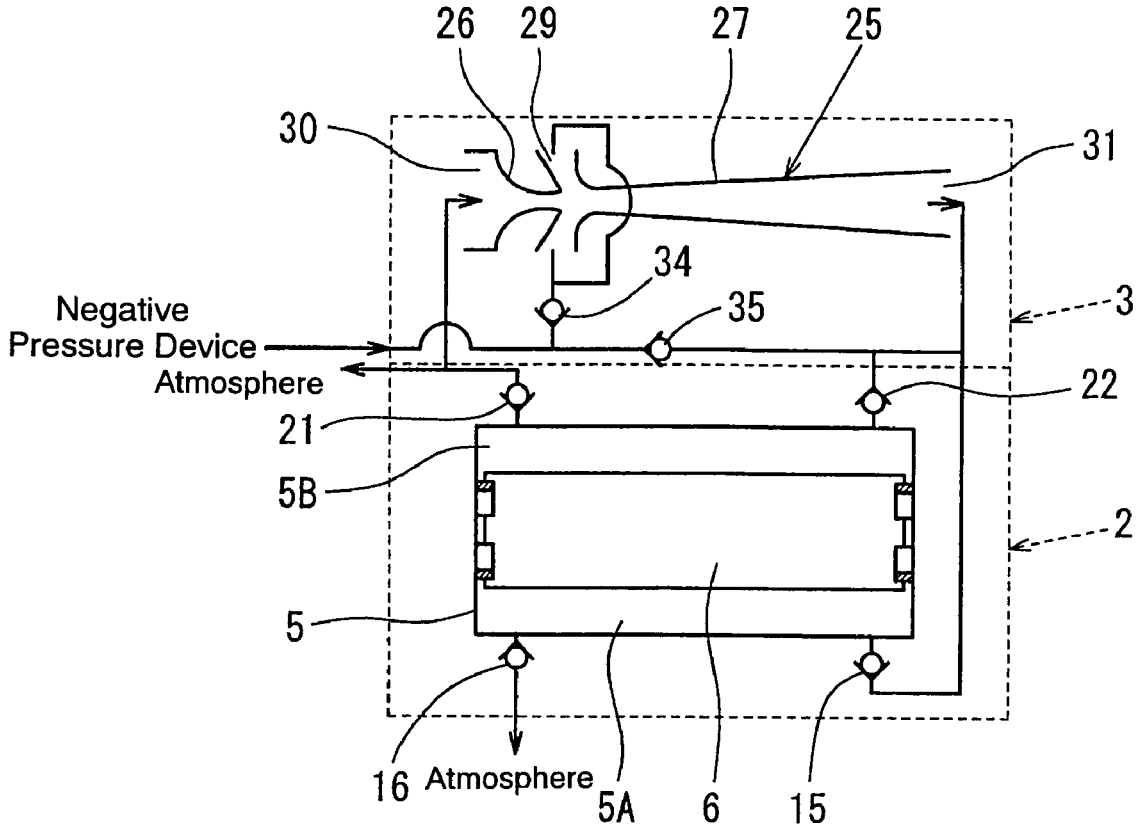
FIG. 5 is a pneumatic pressure circuit diagram showing the arrangement of the apparatus shown in FIG. 4.

As shown in FIGS. 4 and 5, in a negative pressure supply apparatus 39 according to this embodiment, the manifold unit 4 in the first embodiment is omitted, and the vacuum pump unit 2 and the ejector unit 3 are joined directly to each other. The first and second suction ports 12 and 18 of the vacuum pump unit 2 communicate with each other through a passage 40 in a hollow rod 7 and thus communicate directly with the outlet passage 31 of the ejector unit 3. The first and second discharge ports 14 and 20 are open directly to the atmosphere. The inlet 30 of the ejector unit 3 communicates with the first discharge port 14 and hence opens to the atmosphere.

In the vacuum pump unit 2 in this embodiment, the piston 6 has a larger diameter and a shorter stroke than in the first embodiment. Consequently, only two coils 8 are provided in the vacuum pump unit 2 in the second embodiment. In addition, by making use of an extra space resulting from the increase in diameter of the piston 6, the suction-side check valves 15 and 22 and the discharge-side check valves 16 and 21 are disposed along the diametrical direction of the piston 6. Thus, the suction-side check valves 15 and 22 and the discharge-side check valves 16 and 21 are allowed to use identical components to form these different check valves. That is, in the embodiment shown in FIG. 1, the suction-side check valves 15 and 22 and the discharge-side check valves 16 and 21 are provided in concentric relation to each other. Therefore, the check valves 16 and 21 unavoidably become larger in radial dimensions than the check valves 15 and 22. In the embodiment shown in FIG. 4, the end faces of the vacuum pump unit 2 have an increased area. Therefore, two check valves of the same configuration can be installed on each end face in opposite orientations so as to be used for the suction and discharge purposes, respectively.

With the above-described arrangement, the negative pressure produced in the vacuum pump unit 2 can be boosted by the ejector 25, and it is possible to supply a negative pressure of high degree of vacuum that is required for a negative pressure operated device, e.g. a pneumatic booster, while reducing the load on the vacuum pump unit 2, as in the case of the first embodiment. It should be noted that in the second embodiment the inlet 30 of the ejector 25 is supplied with air at the atmospheric pressure.

In addition, the manifold unit 4 in the first embodiment is omitted, and component sharing between the check valves 15, 16, 21 and 22 is allowed. Further, the number of coils 8 is reduced to only two. Therefore, it is possible to simplify the structure and to reduce the production cost in comparison to the first embodiment.

Although the first and second embodiments use a reciprocating piston type pump as a vacuum pump, it is also possible to use a different type of pump, e.g. an axial piston pump, a vane pump, or a scroll pump. As a drive source of the pump, it is possible to use not only a moving magnet type linear motor but also a different type of linear motor, e.g. a linear SRM (Switched Reluctance Motor), which requires no magnet. When a rotary pump is used, a rotary motor is also usable.

What is claimed is:

1. A negative pressure supply apparatus comprising:

an ejector having a nozzle and a diffuser disposed downstream of said nozzle, said ejector having a vacuum port opening between said nozzle and said diffuser; and a vacuum pump having a suction port connected to an outlet of said diffuser, said vacuum pump including:

a piston slidably fitted in a cylinder;

a rod secured in said cylinder and extending along a central axis of said cylinder such that movement of said piston is guided by said rod;

a plurality of coils provided on an outer peripheral portion of said cylinder;

a magnetic path member and a plurality of magnets provided on an outer peripheral portion of said piston; and an annular seal disposed centrally on said magnets to divide the interior of said cylinder into two pump chambers, said vacuum pump being operable by the movement of said piston driven by electrical energization of said plurality of coils so as to produce a negative pressure, wherein a negative pressure of higher degree of vacuum than that of the suction negative pressure of said vacuum pump is produced at said vacuum port of said ejector by operation of said vacuum pump, and the negative pressure of higher degree of vacuum can be supplied to a negative pressure operated device which is operated by a negative pressure, and wherein said vacuum port of said ejector and said suction port of said vacuum pump are connected through respective check valves to a negative pressure supply port which is connected to the negative pressure operated device, so that either one of two negative pressures at said vacuum port and said suction port that is higher in degree of vacuum than the other is supplied from said negative pressure supply port to the negative pressure operated device.

2. A negative pressure supply apparatus according to claim 1, wherein said pump chambers of said vacuum are configured for sucking and discharging air at both ends of said piston.

3. A negative pressure supply apparatus according to claim 1, wherein said ejector has a two-dimensional configuration formed from a planar recess provided on a plane surface.

4. A negative pressure supply apparatus comprising:

an ejector having a nozzle and a diffuser disposed downstream of said nozzle, said ejector having a vacuum port opening between said nozzle and said diffuser; and a vacuum pump having a suction port connected to an outlet of said diffuser, said vacuum pump including:

a piston slidably fitted in a cylinder;

a rod secured in said cylinder and extending along a central axis of said cylinder such that movement of said piston is guided by said rod;

a plurality of coils provided on an outer peripheral portion of said cylinder;

a magnetic path member and a plurality of magnets provided on an outer peripheral portion of said piston; and an annular seal disposed centrally on said magnets to divide the interior of said cylinder into two pump chambers, said vacuum pump being operable by the movement of said piston driven by electrical energization of said plurality of coils so as to produce a negative pressure, wherein a negative pressure of higher degree of vacuum than that of the suction negative pressure of said vacuum pump is produced at said vacuum port of said ejector by operation of said vacuum pump, and the negative pressure of higher degree of vacuum can be supplied to a negative pressure operated device which is operated by a negative pressure, wherein said vacuum pump and said ejector are joined to each other through a manifold unit which includes a suction passage for communication between said outlet of said diffuser and said suction port of said vacuum pump, and wherein said manifold unit further includes a discharge passage for communication between an inlet of said nozzle of said ejector and a discharge port of said vacuum pump.

5. A negative pressure supply apparatus comprising:

an ejector having a nozzle and a diffuser disposed downstream of said nozzle, said ejector having a vacuum port opening between said nozzle and said diffuser; and a vacuum pump having at least one suction port connected to an outlet of said diffuser, said vacuum pump including:

a piston adapted to travel back and forth in a cylinder;

a plurality of coils provided on said cylinder;

a magnet provided on said piston; and a seal disposed between said cylinder and said piston to divide an interior of said cylinder into two pump chambers for sucking and discharging air at both ends of said piston, said vacuum pump being operable by the reciprocating movement of said piston driven by electrical energization of said plurality of coils, so as to produce a negative pressure in each of said pump chambers, wherein a negative pressure of higher degree of vacuum than that of the suction negative pressure of said vacuum pump is produced at said vacuum port of said ejector by operation of said vacuum pump, and the negative pressure of higher degree of vacuum can be supplied to a negative pressure operated device which is operated by a negative pressure, and wherein said vacuum pump further comprises:

a plurality of discharge ports being connected to said pump chambers of said vacuum pump, and a discharge passage for communication between an inlet of said nozzle of said ejector and said discharge ports of said pump chambers of said vacuum pump.

6. A negative pressure supply apparatus according to claim 5, wherein said ejector has a two-dimensional configuration formed from a planar recess provided on a plane surface.

7. A negative pressure supply apparatus according to claim 5, wherein said vacuum pump and said ejector are joined to each other.

8. A negative pressure supply apparatus according to claim 7, wherein said vacuum pump has a plurality of suction ports, each of said pump chambers of said vacuum pump communicates with at least one of the plurality of suction ports, said vacuum pump and said ejector are joined to each other through a manifold unit which includes a suction passage for communication between said outlet of said diffuser and the suction ports of said pump chambers of said vacuum pump.

9. A negative pressure supply apparatus comprising:

an ejector having a nozzle and a diffuser disposed downstream of said nozzle, said ejector having a vacuum port opening between said nozzle and said diffuser; and a vacuum pump having at least one suction port connected to an outlet of said diffuser, said vacuum pump including:

a piston adapted to travel back and forth in a cylinder;

a plurality of coils provided on said cylinder;

a magnet provided on said piston; and a seal disposed between said cylinder and said piston to divide an interior of said cylinder into two pump chambers for sucking and discharging air at both ends of said piston, said vacuum pump being operable by the reciprocating movement of said piston driven by electrical energization of said plurality of coils, so as to produce a negative pressure in each of said pump chambers, wherein a negative pressure of higher degree of vacuum than that of the suction negative pressure of said vacuum pump is produced at said vacuum port of said ejector by operation of said vacuum pump, and the negative pressure of higher degree of vacuum can be supplied to a negative pressure operated device which is operated by a negative pressure, and wherein said vacuum port of said ejector and said suction port of said vacuum pump are connected through respective check valves to a negative pressure supply port which is connected to said negative pressure operated device, so that either one of two negative pressures at said vacuum port and said suction port that is higher in degree of vacuum than the other is supplied from said negative pressure supply port to said negative pressure operated device.

10. A negative pressure supply apparatus according to claim 9, wherein said ejector has a two-dimensional configuration formed from a planar recess provided on a plane surface.

11. A negative pressure supply apparatus according to claim 9, wherein said vacuum pump and said ejector are joined to each other.

12. A negative pressure supply apparatus comprising:

an ejector having a nozzle and a diffuser disposed downstream of said nozzle, said ejector having a vacuum port opening between said nozzle and said diffuser; and a vacuum pump having a suction port connected to an outlet of said diffuser, said vacuum pump having an electrical motor configured to cause relative movement between a plurality of coils and at least one magnet, the motor being operable by electrical energization of said coils so that said vacuum pump can produce a negative pressure, wherein said vacuum pump and said ejector are joined to each other, and wherein a negative pressure of higher degree of vacuum than that of the suction negative pressure of said vacuum pump is produced at said vacuum port of said ejector by operation of said vacuum pump, and the negative pressure of higher degree of vacuum can be supplied to a negative pressure operated device which is operated by a negative pressure, wherein each of said vacuum pump and said ejector are formed as a unit, respectively, wherein said vacuum pump and said ejector are joined to each other through a manifold unit which includes a suction passage for communication between said outlet of said diffuser and said suction port of said vacuum pump, and wherein said manifold further includes a discharge passage for communication between an inlet of said nozzle of said ejector and a discharge port of said vacuum pump.

13. A negative pressure supply apparatus according to claim 12, wherein said vacuum pump further comprises:

a piston adapted to travel back and forth in a cylinder;

a magnetic path member, wherein said magnetic path member and said at least one magnet are provided on said piston; and a seal disposed between said cylinder and said piston to divide an interior of said cylinder into two pump chambers for sucking and discharging air at both ends of said piston, wherein said plurality of coils are provided on said cylinder and said vacuum pump is operable by the reciprocating movement of said piston driven by electrical energization of said plurality of coils, so as to produce a negative pressure in each of said pump chambers.

14. A negative pressure supply apparatus according to claim 13, wherein said vacuum pump and said ejector are joined to each other, such that the axis along which said piston travels back and forth and the central axis of said ejector are parallel to each other.

15. A negative pressure supply apparatus according to claim 13, wherein said vacuum pump has a rod that is secured in said cylinder and extends along a central axis of the cylinder such that movement of said piston is guided by said rod.

* * * * *